United States Patent [19]

Bruccheri

[11] Patent Number: 4,825,553

[45] Date of Patent: May 2, 1989

[54] ANTI-JAMMING DEVICE FOR CHAIN SAW

[76] Inventor: Gaetan Bruccheri, 12, av. Jacques Monod F-52100, Saint Dizier, France

[21] Appl. No.: 162,319

[22] PCT Filed: Jun. 1, 1987

[86] PCT No.: PCT/FR87/00189

§ 371 Date: Jan. 29, 1988

§ 102(e) Date: Jan. 29, 1988

[87] PCT Pub. No.: WO87/07556

PCT Pub. Date: Dec. 17, 1987

[30] Foreign Application Priority Data

Jun. 2, 1986 [FR] France ..... 86 08152

[51] Int. Cl.[4] ..... B27B 17/00

[52] U.S. Cl. ..... 30/383; 30/387

[58] Field of Search ..... 30/382–387; 83/102.1

[56] References Cited

U.S. PATENT DOCUMENTS 4,334,112 8/1985 Bass ..... 30/383

FOREIGN PATENT DOCUMENTS 740965 11/1943 Fed. Rep. of Germany .

*Primary Examiner*—Douglas D. Watts

*Attorney, Agent, or Firm*—Cushman, Darby & Cushman

[57] ABSTRACT

This invention concerns an anti-jamming device for chain saws.

Balls (4) alternating on either side of the side plates (2 and 3) are housed in holes 1*a*) provided in the central web, (1), bear into spherical cavities (2*a* or 3*a*) provided on the internal side of the side plates (2 or 3) and extend on the outside through holes provided in the other side plate (2 or 3).

4 Claims, 3 Drawing Sheets

ANTI-JAMMING DEVICE FOR CHAIN SAW

This invention concerns an anti-jamming device for chain saws.

This safety device concerns in particular internal combustion or electric motor driven portable chain saws, etc. These tools, depending on the motor power and length of the chain guide, are used to cut fire-wood (logs, etc.) and for pruning and felling trees, etc.

Jamming of the chain due to lateral pinching following bending of the piece of wood in the cutting plane can damage the motor or cause accidents. In effect, when the saw is ready to cut through, the chain guide is subjected to very high stresses by the logs, as the cut edges have a tendency to close in and press on the chain guide, causing heating of the motor or projection of the piece of wood, unbalancing the user. This unbalance is the cause of many accidents.

The anti-jamming device according to the invention is aimed at overcoming these drawbacks. This device for chain saws, as characterized in the claims, solves the problem consisting of creating a simple and efficient anti-jamming safety guide, readily adaptable to all types of chain saws with a central web and two side plates as chain guide.

The anti-jamming device for chain saws according to the invention is mainly characterized by balls protruding out from the chain guide plates by a distance corresponding to the rake of the chain teeth, taking into account the cut contour. The balls are similar to those used in ball bearings.

The protruding balls are located alternately on either side of the side planes and housed in holes with a diameter slightly larger than that of the balls, provided in the central web. They bear on the internal surface of the side plates and protrude outside through a hole in the other plate.

On the inside of a side plate, the balls bear in semispherical cavities provided in the side plate and are held captive by the edge of the holes in the chain guide plates to allow them to protrude outside.

The ball diameter is determined so that the protruding part is adjacent to the plane of the cut made by the saw, i.e. the height of this protruding part corresponds to the outward protrusion of the saw teeth, taking into account the contour of the cut, allowing chain saws to be used to the maximum of their sharpening.

The holes in the side plates through which protrude the balls are located alternately on each side plate, fitting the internal contour of the center web, alternately on either side.

The holes allowing the balls to protrude outwards have a concave spherical shape with a radius slightly larger than that of the balls.

The anti-jamming device avoids having to twist the chain during each cut when pruning trees or in the event of problems in cutting.

During cutting, when the chain guide is about to cut through, and the cut edges close in, the balls absorb the stresses and transmit them to the side plates in a balanced manner avoiding jamming, while facilitating movement of the saw through the cutting plane, since the assembly including central web, side plates and balls act as a thrust bearing.

Other characteristics and advantages appear in the description below of a safety device according to the invention, given as a nonrestrictive example, with reference to the drawings in appendix in which.

Figure 1:
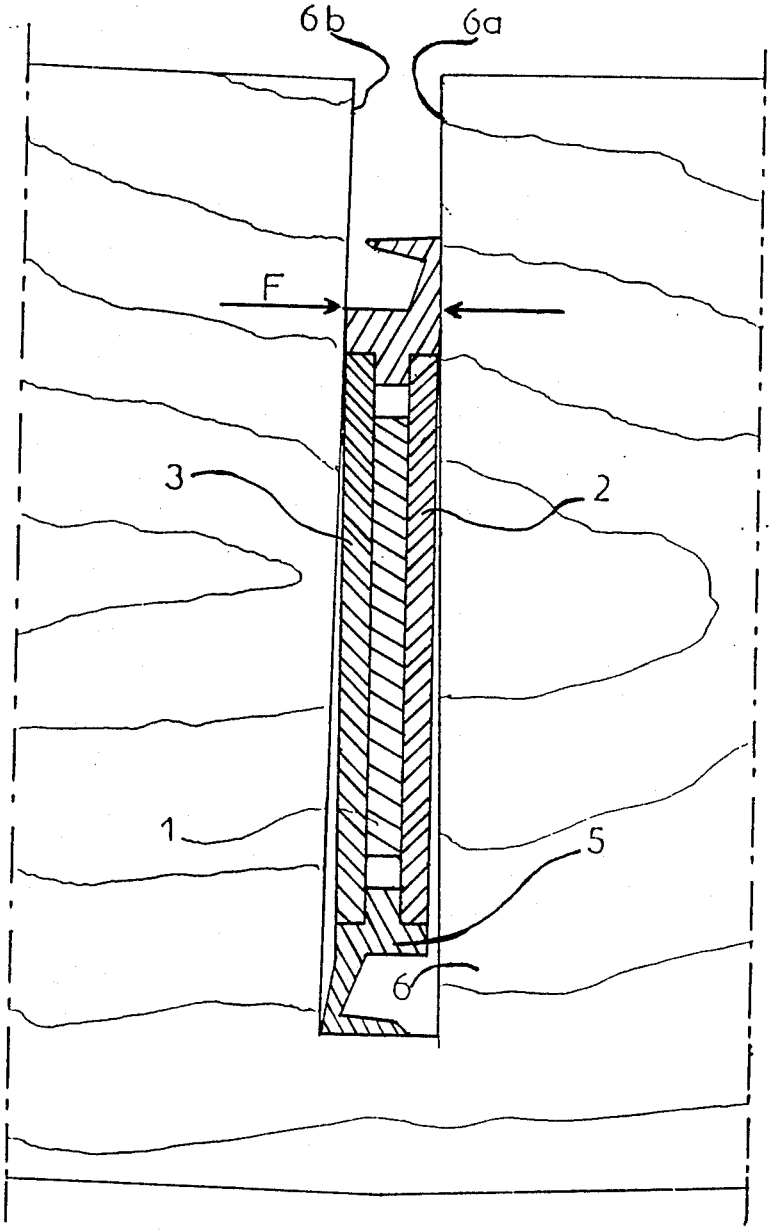
FIG. 1 is a cross section of the chain guide in operation without the anti-jamming device according to the invention
Figure 2:
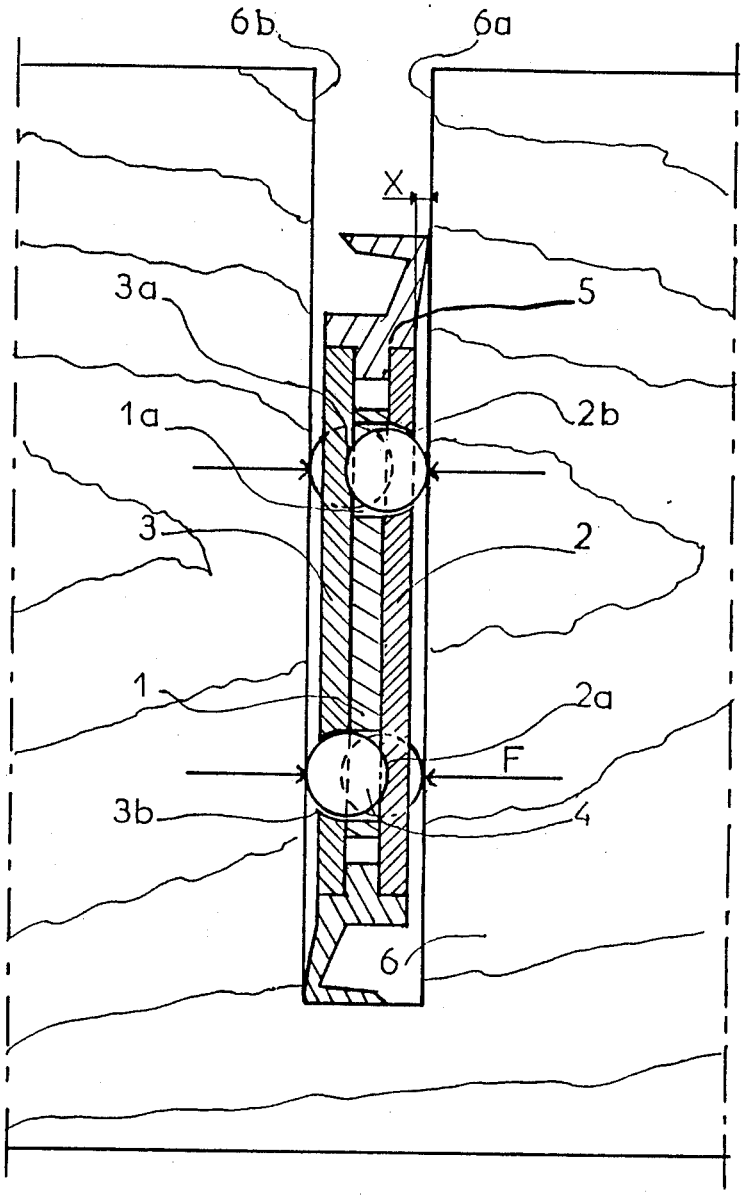
FIG. 2 is a cross section of the chain guide in operation equipped with the device according to the invention.
Figure 3:
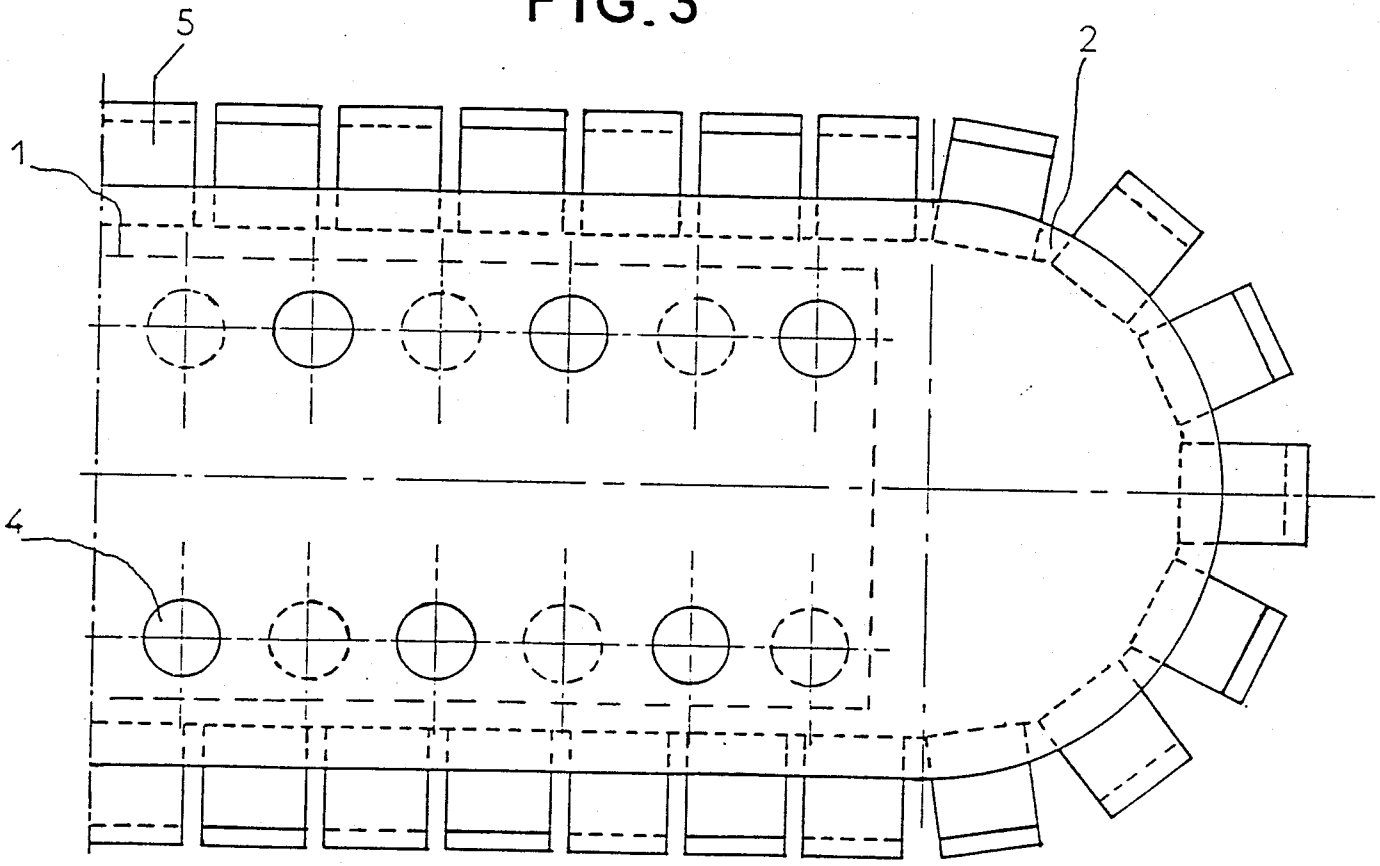
FIG. 3 is a partial side view of the anti-jamming device according to the invention.

FIGS. 2 and 3 show an anti-jamming device for chain saws with central web 1, two chain guide plates 2 and 3 and balls 4 protruding from side plates 2 and 3.

Balls 4 housed in holes 1a provided in central web 1 bear against semispherical cavities **2*a* and 3*a* provided on the internal surface of chain guide side plates 2 and 3 and protrude out through holes 2b and 3b** provided in the opposite side plate.

The outward protrusion of balls 4 corresponds to the external rake of saw teeth 5 taking into account the cut contour.

Referring to FIG. 2, it can be seen that in accordance with the invention, balls 4 protruding by distance X alternate on either side of end plates 2 and 3 so that during cutting, balls 4 support the compression stresses F transmitted by sides 6a and 6b of the cut and piece of wood 6 and directly transfer these stresses to side plates 2 and 3 in a balanced manner while allowing the assembly to slide freely in the cut since said balls 4 remain free to rotate in spite of the stress.

With reference to FIG. 3, it can be seen that in this embodiment, balls 4 are staggered on side plates 2 and 3 along the longitudinal contour of central web 1. The chain saw equipped with this device thus acts as a thrust ball bearing in which sides 6a and 6b of the piece of wood act like the plates on the bearing and central web 1 as well as side plates 2 and 3 as the bearing cage.

The anti-jamming device according to the invention is mainly designed to facilitate use of portable chain saws by nonprofessionals, by providing the best condition of safety.

I claim:

1. In a chain saw having a chain guide and chain saw teeth mounted to said chain guide, said chain guide including a central web and first and second side plates, an anti-jamming device comprising a plurality of balls mounted to said chain guide so as to protrude from either side of the chain guide, said balls being staggered alternately on either side of the chain guide in two rows, said balls protruding from said each side plate of said chain guide an amount corresponding to an external rake of the chain saw teeth mounted to said chain guide.

2. In a chain saw having a chain guide and chain saw teeth mounted to said chain guide, said chain guide including a central web and first and second side plates, an anti-jamming device comprising a plurality of balls mounted to said chain guide, said central web having a plurality of apertures defined therethrough each said aperture having a diameter slightly larger than a diameter of a said ball, said balls being mounted in said apertures, said side first and second plates each having a plurality of holes defined therethrough, each said aperture in said first side plates being offset from apertures in said second side plates so that some of said balls mounted in said apertures of said central web bear on an inner surface of one of said side plates and protrude through apertures defined in the other side plate and others of said balls bear on the inner surface of said other side plate and protrude through apertures defined in said one side plate, said balls EACH protruding from said respective side plates a distance corresponding to the external rake of the chain saw teeth.

3. A chain saw as in claim 2, wherein the semi-spherical cavities against which said balls bear, each of said balls being held captive by the edges of said apertures defined in the side plate through which they protrude.

4. A chain saw as in claim 2, wherein the edges of the apertures through which the balls protrude have a semi-spherical shape having a radius slightly larger than a radius of said balls.

* * * * *